US011434633B2

(12) United States Patent
Post et al.

(10) Patent No.: US 11,434,633 B2
(45) Date of Patent: Sep. 6, 2022

(54) SYSTEM AND ASSOCIATED METHODS FOR MULTISTORY BUILDING CONSTRUCTION

(71) Applicants: Charles Post, Davie, FL (US); Daymon Allman, Lake Worth, FL (US); Luis Diaz, Hialeah, FL (US)

(72) Inventors: Charles Post, Davie, FL (US); Daymon Allman, Lake Worth, FL (US); Luis Diaz, Hialeah, FL (US)

( * ) Notice: Subject to any disclaimer, the term of this patent is extended or adjusted under 35 U.S.C. 154(b) by 0 days.

(21) Appl. No.: 15/929,909

(22) Filed: May 28, 2020

(65) Prior Publication Data

US 2020/0378106 A1 Dec. 3, 2020

Related U.S. Application Data

(60) Provisional application No. 62/855,416, filed on May 31, 2019.

(51) Int. Cl.
*E04B 1/24* (2006.01)

(52) U.S. Cl.
CPC ..... *E04B 1/2403* (2013.01); *E04B 2001/246* (2013.01); *E04B 2001/2415* (2013.01); *E04B 2001/2421* (2013.01)

(58) Field of Classification Search
CPC ..... E04B 1/2403; E04B 2001/2421; E04B 2001/2415; E04B 2001/246; E04B 2001/2463; E04B 2001/2451
USPC ..... 52/170, 236.3, 236.9, 656.9, 848, 655.1
See application file for complete search history.

(56) References Cited

U.S. PATENT DOCUMENTS 949,394 A * 2/1910 Daly ..... E04B 1/2403 296/9
1,555,847 A * 10/1925 Hudson ..... E04G 7/20 182/178.5
3,304,683 A * 2/1967 Ferreira ..... E04B 2/58 256/65.14
3,462,021 A * 8/1969 Hawke ..... F16B 12/40 403/174
3,938,294 A * 2/1976 Gaburri ..... E04B 1/3505 52/834
4,630,550 A * 12/1986 Weitzman ..... A47B 13/06 403/171
5,568,909 A * 10/1996 Timko ..... E04H 12/2261 52/298
5,660,005 A * 8/1997 Tacoma ..... E04B 7/022 52/273

(Continued)

*Primary Examiner* — Brian E Glessner
*Assistant Examiner* — Adam G Barlow
(74) *Attorney, Agent, or Firm* — George P. Zies

(57) ABSTRACT

A multistory building construction system comprising at least one base plate comprising a centrally disposed sleeve extending vertically from a top surface thereof and configured to engage an interior portion of a bottom end of at least one first-floor column comprising a cap plate disposed on a top end thereof with a centrally disposed sleeve extending vertically therefrom configured to engage an exterior portion of a bottom end of at least one upper-floor column and configured to support a decking for a concrete floor and configured so that a top end of the sleeve may be used as a benchmark for pouring the concrete floor, the first-floor column and the upper-floor column further comprising at least one sheer tab for attachment of beams for support of the decking.

8 Claims, 1 Drawing Sheet

(56) References Cited

U.S. PATENT DOCUMENTS 5,680,737 A * 10/1997 Sheipline ..... F16B 7/0453 403/205
6,082,070 A * 7/2000 Jen ..... E04H 12/2253 403/217
6,151,851 A * 11/2000 Carter ..... E04B 1/3511 52/849
9,004,439 B2 * 4/2015 Gross ..... E04H 12/2269 248/507
9,334,642 B1 * 5/2016 Tanaka ..... E04B 1/2403
10,745,901 B2 * 8/2020 Steyl ..... E04B 1/2403
10,876,282 B1 * 12/2020 Mou ..... E04B 1/2608
10,961,696 B2 * 3/2021 Mou ..... E04H 9/0237
2003/0009977 A1 * 1/2003 Houghton ..... E04C 3/32 52/92.1
2003/0041549 A1 * 3/2003 Simmons ..... E04B 1/2403 52/655.1
2003/0230039 A1 * 12/2003 Rizzotto ..... E04C 5/06 52/295
2006/0010825 A1 * 1/2006 Schubert ..... E04B 1/24 52/741.1
2006/0265992 A1 * 11/2006 Hiragaki ..... E04B 5/43 52/633
2007/0079567 A1 * 4/2007 Leslie ..... E04B 1/24 52/297
2008/0053020 A1 * 3/2008 Collins ..... E04B 1/24 52/282.4
2010/0071305 A1 * 3/2010 Collins ..... E04B 1/24 52/704
2016/0097209 A1 * 4/2016 Angelo ..... E04G 23/0229 52/297
2017/0044753 A1 * 2/2017 Bowron ..... E04B 1/1903
2017/0233996 A1 * 8/2017 Abernathy ..... F16B 7/182 52/698
2017/0314254 A1 * 11/2017 Houghton ..... E04B 1/1912
2018/0135295 A1 * 5/2018 Bowron ..... E04B 1/34838
2018/0245329 A1 * 8/2018 Yu ..... E04B 1/5812
2018/0245331 A1 * 8/2018 Tang ..... E04B 1/2403
2019/0078321 A1 * 3/2019 Bowron ..... E04B 1/343
2019/0323223 A1 * 10/2019 Theriot ..... E04C 3/32
2019/0330838 A1 * 10/2019 Bowron ..... E04B 1/2403
2019/0376273 A1 * 12/2019 Mou ..... E04H 9/024

* cited by examiner

SYSTEM AND ASSOCIATED METHODS FOR MULTISTORY BUILDING CONSTRUCTION

RELATED APPLICATIONS

The present application claims the benefit of U.S. Provisional Patent Application Ser. No. 62/855,416 titled SYSTEM AND ASSOCIATED METHODS FOR MULTISTORY BUILDING CONSTRUCTION filed by the inventor of the present invention on May 31, 2019, the entire contents of which are incorporated herein by reference.

FIELD OF THE INVENTION

The present invention relates generally to the field of multistory building construction and, more particularly, to systems and methods for the construction of multistory buildings utilizing a unique post-fit telescoping and non-telescoping support column system.

BACKGROUND

Typically, multistory steel-framed buildings are constructed using vertical steel columns spanning the full height of the building. For buildings of only a few stories, each column is commonly provided in one piece. For buildings of more than a few stories, each column is commonly provided by multiple column members connected by welding and/or bolted plates with each column member spanning several floors. Intermediate floors are typically framed with horizontal beams attached to the columns by sheer tabs or welding. Joists and floor decking are commonly installed on the horizontal beams.

While such basic construction systems generally provide a very strong vertical column, each such column member is typically quite long and, therefore, quite heavy. These long and heavy columns typically require lifting equipment to hoist them and place them in position or teams of laborers to accomplish these tasks. Lifting equipment, such as cranes or other mechanical hoisting devices, and teams of laborers add significant expenses to the typical construction project as well as adding coordination difficulties and time delays to the typical construction project.

Advances in the art of multistory building construction include the following:

U.S. Pat. No. 5,444,957 describes a method of erecting the frame of a multistory structure and constructing poured concrete floor slabs of a multistory structure. However, this method involves terminating the vertical support members just below the level of the finished floor slab and chipping away a portion of the finished floor slab to expose the vertical support member terminations.

U.S. Pat. No. 6,151,851 describes a stackable support column system and method for multistory building construction. However, this system involves the use of a cumbersome full first column or base column for attachment to the floor, and a base retainer attached to a lower portion of each column.

U.S. Pat. Appl. No. US 2005/0097844 describes a method and system of construction of a multistory building. However, this system involves the use of columns with an upper planar surface in which an aperture is centrally disposed. Columns for succeeding floors have a plate on a bottom surface thereof with an alignment pin extending therefrom for insertion into the aperture of the lower-floor columns.

U.S. Pat. Appl. No. US 2006/0010825 describes a method, building and system for constructing a multistory building. However, this system involves the use of a connector into which a lower-floor column and an upper-floor column slidingly fit and which connectors are fastened to the lower-floor and upper-floor columns.

U.S. Pat. Appl. No. US 2007/0079567 describes a method and system for constructing a multistory building. However, this system involves the use of a footing into which grout is placed and then a lower portion of a first-floor column is inserted into the footing. The first-floor column is fastened to the footing with self-tapping screws. An internal connector is partially inserted into the top of the first-floor column and into the bottom of an upper-floor column. The internal connector is fastened to the lower-floor and upper-floor columns.

U.S. Pat. Appl. No. US 2008/0053020 describes a method and system for constructing a multistory building. However, this system involves the use of a connector into which a lower-floor column and an upper-floor column slidingly fit and which connectors are bifurcated horizontally by a plate. A base plate telescopically receives the bottom end of the lowest-floor column.

A need exists for an alternative system and method for the construction of multistory buildings that may overcome the known shortcomings in the art.

While certain aspects of conventional technologies have been discussed to facilitate disclosure of the invention, the applicant in no way disclaims these technical aspects, and it is contemplated that the claimed invention may encompass one or more of the conventional technical aspects discussed herein. The present invention may address one or more of the problems and deficiencies of the advances in the art of multistory building construction discussed above. However, it is contemplated that the invention may prove useful in addressing other problems and deficiencies in a number of technical areas. Therefore, the claimed invention should not necessarily be construed as being limited to addressing any of the particular problems or deficiencies discussed herein or as being limited to the particular embodiment for the invention used to illustrate the steps and functionality of the herein disclosed invention.

This background information is provided to reveal information believed by the applicant to be of possible relevance to the present invention. No admission is necessarily intended, or should be construed, that any of the preceding information constitutes prior art against the present invention. This reference or discussion is not an admission that the document, act or item of knowledge, or any combination thereof, was at the priority date, publicly available, known to the public, part of common general knowledge, or otherwise constitutes prior art under the applicable statutory provisions; or is known to be relevant to an attempt to solve any problem with which this specification is concerned.

SUMMARY OF THE INVENTION

With the above in mind, embodiments of the present invention are related to systems and processes for constructing multistory buildings utilizing a unique post-fit telescoping and non-telescoping column system. Such post-fit column system may advantageously expand the commercial usefulness of multistory building construction. The products of such systems and processes may advantageously be enjoyed by developers, property owners and those who plan and labor in the construction of multistory buildings.

A multistory building construction system may comprise at least one base plate, at least one first-floor column and at least one upper-floor column. The at least one base plate may comprise a centrally disposed sleeve extending vertically from a top surface thereof and a plurality of openings disposed therein to permit passage of a corresponding plurality of fasteners. The at least one first-floor column may comprise a cap plate disposed on a top end thereof, a cap plate sleeve centrally disposed on a top surface of the cap plate and at least one sheer tab. The cap plate of the first-floor column may have a lateral dimension greater than a lateral dimension of the at least one first-floor column, so that the lateral dimension of the cap plate projects beyond the lateral dimension of the first-floor column on two opposing sides of the first-floor column. The cap plate sleeve of the first-floor column may extend vertically from the top surface of the cap plate of the first-floor column. The at least one sheer tab of the first-floor column may be disposed orthogonally to the lateral dimension of the first-floor column and may be oriented vertically. The at least one upper-floor column may comprise a cap plate disposed on a top end thereof, a cap plate sleeve centrally disposed on a top surface of the cap plate and at least one sheer tab. The cap plate of the upper-floor column may have a lateral dimension greater than a lateral dimension of the at least one upper-floor column, so that the lateral dimension of the cap plate of the upper-floor column projects beyond the lateral dimension of the upper-floor column on two opposing sides of the upper-floor column. The cap plate sleeve of the upper-floor column may extend vertically from the top surface of the cap plate of the upper-floor column. The at least one sheer tab of the upper-floor column may be disposed orthogonally to the lateral dimension of the upper-floor column and may be oriented vertically. The at least one first-floor column may have a cross-sectional shape that is substantially similar to a cross-sectional shape of the sleeve of the base plate. The at least one first-floor column may have an interior dimension slightly larger than an exterior dimension of the sleeve of the base plate. The cross-sectional shape of the sleeve of the at least one first-floor column may be substantially similar to a cross-sectional shape of the at least one upper-floor column. The sleeve of the cap plate of the at least one first-floor column may have an interior dimension slightly larger than an exterior dimension of the at least one upper-floor column. The sleeve of the cap plate of the at least one first-floor column may have a vertical dimension substantially similar to a thickness of a concrete floor poured over a decking. The sleeve of the cap plate of the at least one upper-floor column may have a vertical dimension substantially similar to the thickness of the concrete floor poured over the decking.

A method for multistory building construction may comprise the steps of positioning at least one base plate on a concrete slab of a multistory building site at a location suitable for carrying a load from at least one upper floor of the multistory building; attaching the at least one base plate to the concrete slab; matingly engaging at least one first-floor column with a sleeve of the at least one base plate so that the sleeve extends into a bottom end of the at least one first-floor column; truing and plumbing the at least one first-floor column on the sleeve of the at least one base plate; positioning the at least one first-floor column at a desired height according to engineering plans to support the load from the at least one upper floor of the multistory building; welding the at least one first-floor column to the base plate according to engineering plans; attaching beams to sheer tabs affixed to at least one side of the at least one first-floor column; installing a steel deck supported by the beams and by a cap plate of the at least one first-floor column; lubricating an interior of a sleeve of the at least one first-floor column; covering the interior of the sleeve of the at least one first-floor column; pouring concrete for an upper floor using a top of the sleeve of the at least one first-floor column as a benchmark; allowing the concrete to cure; sealing the concrete; uncovering the sleeve of the at least one first-floor column; inserting a bottom end of at least one upper-floor column into the sleeve of the at least one first-floor column; truing and plumbing the at least one upper-floor column within the sleeve of the at least one first-floor column; positioning the at least one upper-floor column at a desired height according to engineering plans to support a load from above; welding the at least one upper-floor column to the sleeve of the at least one first-floor column; and placing a load on the upper-floor column.

DETAILED DESCRIPTION OF THE INVENTION

Figure 2:
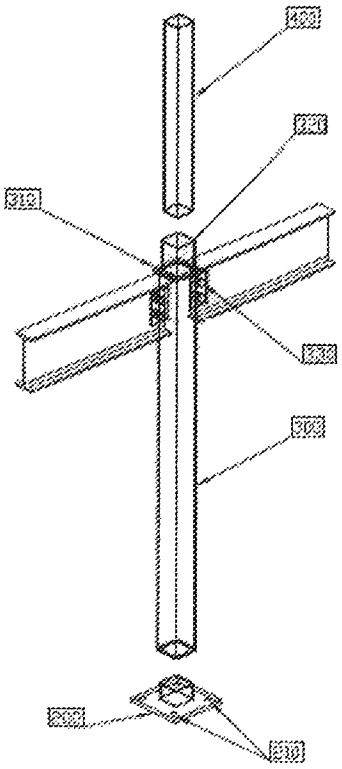
FIG. 2 is an exploded perspective view of an exemplary stackable column system according to an embodiment of the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred-to object, characteristic, or quality constitutes a majority of the subject of the reference. The meaning of any of these terms is dependent upon the context within which it is used, and the meaning may be expressly modified.

Throughout this disclosure, the present invention may be referred to as a post-fit support column system, a telescoping support column system, a non-telescoping support columns system, a stackable support column system, a post-fit column system, a telescoping column system, a non-telescoping column system, a stackable column system, a support column system, a multistory building construction system, a multistory building construction method, a multistory construction system, a multistory construction method, a construction method, a product, a system, a device, and a method. Furthermore, the present invention may be referred to as relating to generic multistory construction methods and tools. Those skilled in the art will appreciate that this terminology does not affect the scope of the invention.

In the following description, for purposes of explanation, numerous specific details are set forth to provide a thorough understanding of example embodiments. It will be evident, however, to one of ordinary skill in the art that the present invention may be practiced without these specific details and/or with different combinations of the details than are given here. Thus, specific embodiments are given for the purpose of simplified explanation and not for limitation.

An embodiment of the invention, as shown and described by the various figures and accompanying text, provides a multistory building construction system according to an embodiment of the present invention. The multistory building construction system may implement a system to construct a multistory building in a cost-effective, labor saving, and structurally sound manner.

Figure 1:
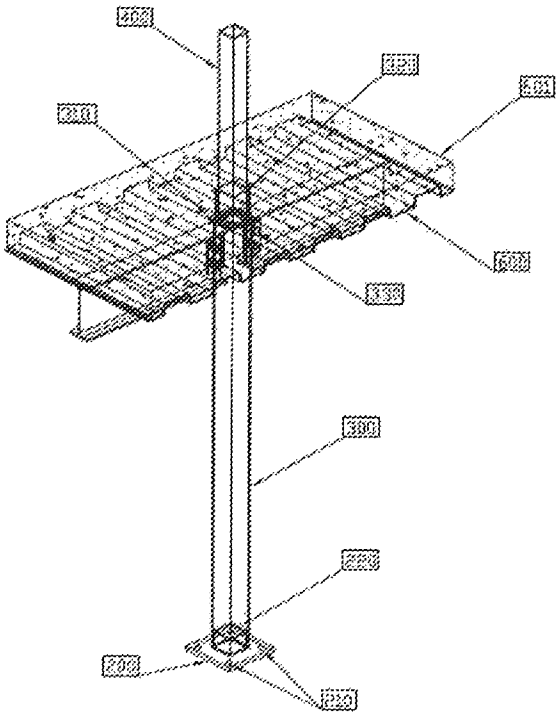
FIG. 1 is a perspective view of an exemplary stackable column system according to an embodiment of the present invention.

Referring more specifically to FIGS. 1 and 2, the multistory building construction system 100, according to an embodiment of the present invention, will now be discussed. The system 100 may include at least one base plate 200, which may be positioned on a slab of a multistory building site according to engineering plans at a location suitable for carrying a load from at least one upper floor of the multistory building. The at least one base plate 200 may be fastened or affixed to the slab. The at least one base plate 200 may have a plurality of openings 210 disposed therein to permit the passage of a corresponding plurality of fasteners therethrough to secure the at least one base plate to the slab. The at least one base plate 200 may have a sleeve 220 extending vertically from a top surface thereof. The sleeve 220 may be welded to the top surface of the at least one base plate 200 along an interior seam between a bottom of the sleeve and the at least one base plate top surface.

The system 100 may also include at least one first-floor column 300 with a cross-sectional shape that is substantially similar to a cross-sectional shape of the sleeve 220. The at least one first-floor column 300 may be sized so that an interior dimension of the at least one first-floor column is slightly larger than an exterior dimension of the sleeve 220. The at least one first-floor column 300 may be configured to matingly engage with the sleeve 220 of the at least one base plate 200, so that the sleeve extends into a bottom end of the at least one first-floor column. The at least one first-floor column 300 may be adjusted on the at least one base plate 200 so as to be trued and plumbed and so as to achieve a desired height according to engineering plans to support the load from the at least one upper floor of the multistory building. The at least one first-floor column 300 may be affixed to the at least one base plate 200 by welding or by other suitable means according to engineering plans.

The at least one first-floor column 300 may have a cap plate 310 affixed to a top end thereof. The cap plate 310 may have a width consistent with a width of the at least one first-floor column 300. The cap plate 310 may have a lateral distance that is longer than a lateral distance of the at, least one first-floor column 300. In one embodiment of the present invention, the lateral distance of the cap plate 310 is six inches (6") greater than the lateral distance of the at least one first-floor column 300. The cap plate 310, according to one embodiment of the present invention, may be positioned on the top end of the at least one first-floor column 300 so that approximately three inch (3") of the cap plate extends horizontally beyond a first side of the lateral distance of the at least one first-floor column and so that approximately three inches (3") of the cap plate extends horizontally beyond an opposite second side of the lateral distance of the at least one first-floor column. The at least one first-floor column 300 may have at least one sheer tab 330 affixed to the width of the at least one first-floor column oriented vertically. The at least one sheer tab 330 may be configured to be affixed to an end of a beam. The at least one sheer tab 330 may be positioned so that when the beam is affixed thereto, the beam and the cap plate 310 may support a decking 600 for a concrete floor 601. The at least one first-floor column 300 may have a sleeve 320 affixed to a top surface of the cap plate 310 extending vertically therefrom. The sleeve 320 may be welded to the top surface of the cap plate 310 along an exterior seam between a bottom of the sleeve and the cap plate top surface.

The system 100 may also include at least one second-floor column 400 with a cross-sectional shape that is substantially similar to a cross-sectional shape of the sleeve 320. The sleeve 320 may be sized so that an interior dimension of the sleeve is slightly larger than an exterior dimension of the at least one second-floor column 400. In one embodiment of the present invention, the exterior dimension of the at least one second-floor column 400 is substantially similar to an exterior dimension of the at least one first-floor column 300. In another embodiment of the present invention, the exterior dimension of the at least one second-floor column 400 is slightly less than the exterior dimension of the at least one first-floor column 300. The at least one second-floor column 400 may be configured to matingly engage with the sleeve 320, so that a bottom end of the at least one second-floor column extends into the sleeve. The at least one second-floor column 400 may be adjusted within the sleeve 320 so as to be trued and plumbed and so as to achieve a desired height according to engineering plans to support the load from a higher floor of the multistory building. The at least one second-floor column 400 may be affixed to the sleeve 320 by welding or by other suitable means according to engineering plans.

The at least one second-floor color n 400 may have cap plate 410 affixed to a top end thereof. The cap plate 410 may have a width consistent with a width of the at least one second-floor column 400. The cap plate 410 may have a length that is longer than a length of the at least one second-floor column 400. In one embodiment of the present invention, the length of the cap plate 410 is six inches (6") longer than the length of the at least one second-floor column 400. The cap plate 410, according to one embodiment of the present invention, may to positioned on the top end of the at least one second-floor column 400 so that approximately three inches (3") of the cap plate extends horizontally beyond a first side of the length of the at least one second-floor column and so that approximately three inches (3") of the cap plate extends horizontally beyond an opposite second side of the length of the at least one second-floor column. The at least one second-floor column 400 may have at least one sheer tab 430 affixed to the width of the at least one second-floor column oriented vertically. The at least one sheer tab 430 may be configured to be affixed to an end of a beam. The at least one sheer tab 430 may be positioned so that when the beam is affixed thereto, the beam and the cap plate 410 may support a decking 600 for a concrete floor 601. The at least one second-floor column 400 may have a sleeve 420 affixed to a top surface of the cap plate 410 extending vertically therefrom. The sleeve 420 may be welded to the top surface of the cap plate 410 along an exterior seam between a bottom of the sleeve and the cap plate top surface.

The sleeve 320, 420 may have a height that is substantially similar to a thickness of the decking 600 and the concrete floor 601. In one embodiment of the present invention, the decking is provided by corrugated steel. A top end of the sleeve 320, 420 may act as a benchmark for pouring concrete for the concrete floor. In one embodiment of the present invention, a lubricant such as vegetable oil is applied to an interior of the sleeve 320, 420. An opening in the top end of the sleeve 320, 420 may be covered to prevent concrete from entering therein. In one embodiment of the present invention, a foam is sprayed in the interior of the sleeve 320, 420 to prevent concrete from entering therein. After the deck is installed and the opening of the sleeve 320, 420 is covered, the concrete is poured and leveled. After the concrete cures and is sealed, the opening of the sleeve 320, 420 is cleared. In one embodiment of the present invention, an extractor tool is used to remove the foam from the opening of the sleeve 320, 420.

In multistory building projects involving more than two (2) stories, the system 100 may include at least one upper-floor column 500 with a cross-sectional shape that is substantially similar to a cross-sectional shape of the sleeve 320, 420 for each floor above the second floor. An exterior dimension of the at least one upper-floor column 500 is slightly smaller than an interior dimension of a lower-story sleeve. In one embodiment of the present invention, the exterior dimension of the at least one upper-floor column 500 is substantially similar to an exterior dimension of at least one lower-floor column. In another embodiment of the present invention, the exterior dimension of the at least one upper-floor column 500 is slightly less than the exterior dimension of the at least one lower-floor column. The at least one upper-floor column 500 may be configured to matingly engage with the lower-story sleeve, so that a bottom end of the at least one upper-floor column extends into the lower-story sleeve. The at least one upper-floor column 500 may be adjusted within the lower-story sleeve so as to be trued and plumbed and so as to achieve a desired height according to engineering plans to support the load from a higher floor of the multistory building. The at least one upper-floor column 500 may be affixed to the lower-story sleeve by welding or by other suitable means according to engineering plans.

The at least one upper-floor column 500 may have a cap plate 510 affixed to a top end thereof. The cap pate 510 may have a width consistent with a width of the at least one upper-floor column 500. The cap plate 510 may have a length that is longer than a length of the at least one upper-floor column 500. In one embodiment of the present invention, the length of the cap plate 510 is six inches (6") longer than the length of the at least one upper-floor column 500. The cap plate 510, according to one embodiment of the present invention, may be positioned on the top end of the at least one upper-floor column 500 so that approximately three inches (3") of the cap plate extends horizontally beyond a first side of the length of the at least one upper-floor column and so that approximately three inches (3") of the cap plate extends horizontally beyond an opposite second side of the length of the at least one upper-floor column. The at least one upper-floor column 500 may have at least one sheer tab 530 affixed to the width of the at least one upper-floor column oriented vertically. The at least one sheer tab 530 may be configured to be affixed to an end of a beam. The at least one sheer tab 530 may be positioned so that when the beam is affixed thereto, the beam and the cap plate 510 may support a decking 600 for a concrete floor 601. The at least one upper-floor column 500 may have a sleeve 520 affixed to a top surface of the cap plate 510 extending vertically therefrom. The sleeve 520 may be welded to the top surface of the cap plate 510 along an exterior seam between a bottom of the sleeve and the cap plate top surface.

The sleeve 520 may have a height that is substantially similar to a thickness of the decking 600 and the concrete floor 601. In one embodiment of the present invention, the decking 600 is provided by corrugated steel. A top end of the sleeve 520 may act as a benchmark for pouring concrete for the concrete floor 601. In one embodiment of the present invention, a lubricant such as vegetable oil is applied to an interior of the sleeve 520. An opening in the top end of the sleeve 520 may be covered to prevent concrete from entering therein. In one embodiment of the present invention, a foam is sprayed in the interior of the sleeve 520 to prevent concrete from entering therein. After the deck is installed and the opening of the sleeve 520 is covered, the concrete is poured and leveled. After the concrete cures and is sealed, the opening of the sleeve 520 is cleared. In one embodiment of the present invention, an extractor tool is used to remove the foam from the opening of the sleeve 520.

In one embodiment of the present invention, at least one base plate is positioned on a concrete slab of a multistory building site at a location suitable for carrying a load from at least one upper floor of the multistory building and is attached thereto. At least one first-floor column matingly engages with the sleeve of the at least one base plate so that the sleeve extends into the bottom end of the at least one first-floor column. The at least one first-floor column is trued and plumbed on the sleeve of the at least one base plate and is positioned at a desired height according to engineering plans to support the load from the at least one upper floor of the multistory building. The at least one first-floor column is welded to the base plate according to engineering plans.

Beams are attached to sheer tabs on either side of the at least one first-floor column. A steel deck is installed supported by the beams and the cap plate. The interior of the sleeve of the at least one first-floor column is lubricated with vegetable oil and then filled with foam. Concrete for the second floor is poured using the top of the sleeve of the at least one first-floor column as a benchmark. Once the concrete cures and is sealed, the foam is removed from the sleeve of the at least one first-floor column. The bottom end of the at least one second-floor column is inserted into the sleeve of the at least one first-floor column. The at least one second-floor column is trued and plumbed within the sleeve of the at least one first-floor column and is positioned at a desired height according to engineering plans to support the load from the at least one upper floor of the multistory building. The at least one second-floor column is welded to the sleeve of the at least one first-floor column. For each floor above the second floor, the process is repeated with at least one upper-floor column at each level of the multistory building.

A multistory building construction method comprises the steps of positioning at least one base plate 200 on a concrete slab of a multistory building site at a location suitable for carrying a load from above within the multistory building; attaching the at least one base plate to the concrete slab;

matingly engaging at least one first-floor column 300 with a sleeve 220 of the at least one base plate so that the sleeve of the at least one base plate extends into a bottom end of the at least one first-floor column; truing and plumbing the at least one first-floor column on the sleeve of the at least one base plate; positioning the at least one first-floor column at a desired height according to engineering plans to support the load from above within the multistory building; welding the at least one first-floor column to the base plate according to engineering plans; attaching beams to sheer tabs 330 affixed to at least one side of the at least one first-floor column; installing a steel deck supported by the beams and by a cap plate 310 of the at least one first-floor column; lubricating an interior of a sleeve of the at least one first-floor column; covering the interior of the sleeve of the at least one first-floor column; pouring concrete for an upper floor using a top of the sleeve of the at least one first-floor column as a benchmark; allowing the concrete to cure; sealing the concrete; uncovering the sleeve of the at least one first-floor column; inserting a bottom end of at least one upper-floor column 400, 500 into the sleeve of the at least one first-floor column; truing and plumbing the at least one upper-floor column within the sleeve of the at least one first-floor column; positioning the at least one upper-floor column at a desired height according to engineering plans to support a load from above within the multistory building; welding the at least one upper-floor column to the sleeve of the at least one first-floor column; and placing the load upon the upper-floor column.

The load may comprise a roof structure, and may further comprise the steps of attaching beams to sheer tabs 430, 530 affixed to at least one side of the at least one upper-floor column 400, 500 and installing the roof structure supported by the beams and by a cap plate 410, 510 of the at least one upper-floor column. The load may, alternatively, comprise at least one upper floor and a roof structure, wherein the at least one upper floor comprises one floor and may further comprise the steps of matingly engaging a sleeve 320, 420 of a cap plate 310, 410 of the at least one upper-floor column 300, 400 with a bottom end of a second at least one upper-floor column 400 so that the bottom end of the second at least one upper-floor column extends into an opening in a top of the sleeve of the at least one upper-floor column; truing and plumbing the second at least one first-floor column within the sleeve of the cap plate of the at least one upper-floor column; positioning the second at least one upper-floor column at a desired height according to engineering plans to support the roof structure; welding the second at least one upper-floor column to the sleeve of the cap plate of the at least one upper-floor column according to engineering plans; attaching beams to sheer tabs affixed to at least one side of the second at least one upper-floor column; and installing the roof structure supported by the beams and by a cap plate of the third at least one upper-floor column.

In an alternative embodiment the load may comprise at least one upper floor and a roof structure, wherein the at least one upper floor comprises two floors and may further comprise the steps of matingly engaging a sleeve of 320, 420 a cap plate of the at least one upper-floor column 300, 400 with a bottom end of a second at least one upper-floor column so that the bottom end of the second at least one upper-floor column extends into an opening in a top of the sleeve of the at least one upper-floor column; truing and plumbing the second at least one first-floor column within the sleeve of the cap plate of the at least one upper-floor column; positioning the second at least one upper-floor column at a desired height according to engineering plans to support an additional load from above within the multistory building; welding the second at least one upper-floor column to the sleeve of the cap plate of the at least one upper-floor column according to engineering plans; attaching beams to sheer tabs affixed to at least one side of the second at least one upper-floor column; installing a steel deck supported by the beams and by the cap plate of the second at least one upper-floor column; lubricating an interior of a sleeve of the second at least one upper-floor column; covering the interior of the sleeve of the second at least one upper-floor column; pouring concrete for an upper floor using a top of the sleeve of the second at least one upper-floor column as a benchmark; allowing the concrete to cure; sealing the concrete; uncovering the sleeve of the second at least one upper-floor column; inserting a bottom end of a third at least one upper-floor column into the sleeve of the second at least one upper-floor column; truing and plumbing the third at least one upper-floor column within the sleeve of the second at least one upper-floor column; positioning the third at least one upper-floor column at a desired height according to engineering plans to support the roof structure; welding the third at least one upper-floor column to the sleeve of the second at least one first-floor column; attaching beams to sheer tabs 330, 430 affixed to at least one side of the third at least one upper-floor column and installing the roof structure supported by the beams and by a cap plate of the third at least one upper-floor column.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made, and equivalents may be substituted, for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are, unless otherwise stated, used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus the scope of the invention should be determined by the appended claims and their legal equivalents, and not by the examples given.

That which is claimed is:

1. A multistory building construction system comprising:

At least one base plate with a centrally disposed sleeve affixed to and extending vertically from a top surface thereof;

at least one first-floor column comprising a cap plate disposed on and affixed to a top end thereof, and a sleeve centrally disposed on and affixed to a top surface of the cap plate and extending vertically therefrom, the sleeve having a lower surface that is centrally disposed on and affixed to a top surface of the cap plate; and at least one upper-floor column comprising a cap plate disposed on and affixed to a top end thereof, and a sleeve centrally disposed on and affixed to a top surface of the cap plate and extending vertically therefrom, the sleeve having a lower surface that is centrally disposed on and affixed to a top surface of the cap plate.

2. The multistory building construction system according to claim 1 wherein the at least one first-floor column has a cross-sectional shape that is substantially similar to a cross-sectional shape of the sleeve of the base plate, the at least one first-floor column has an interior dimension slightly larger than an exterior dimension of the sleeve of the base plate, the cross-sectional shape of the sleeve of the cap plate of the at least one first-floor column is substantially similar to a cross-sectional shape of the at least one upper-floor column, and the sleeve of the cap plate of the at least one first-floor column has an interior dimension slightly larger than an exterior dimension of the at least one upper-floor column.

3. The multistory building construction system according to claim 2 wherein the at least one base plate further comprises a plurality of openings disposed therein to permit passage of a corresponding plurality of fasteners, the cap plate of the at least one first-floor column further comprises a lateral dimension greater than a lateral dimension of the at least one first-floor column, so that the cap plate of the at least one first-floor column projects beyond the lateral dimension of the at least one first-floor column on two opposing sides of the at least one first-floor column, and the at least one first-floor column further comprises at least one sheer tab disposed orthogonally to the lateral dimension of the at least one first-floor column and oriented vertically.

4. The multistory building construction system according to claim 3 wherein the cap plate of the at least one upper-floor column further comprises a lateral dimension greater than a lateral dimension of the at least one upper-floor column, so that the cap plate of the at least one upper-floor column projects beyond the lateral dimension of the at least one upper-floor column on two opposing sides of the at least one upper-floor column, and the at least one upper-floor column further comprises at least one sheer tab disposed orthogonally to the lateral dimension of the at least one upper-floor column and oriented vertically.

5. The multistory building construction system according to claim 4 wherein the sleeve of the cap plate of the at least one first-floor column has a vertical dimension substantially similar to a thickness of a concrete floor poured over a decking and the sleeve of the cap plate of the at least one upper-floor column has a vertical dimension substantially similar to the thickness of the concrete floor poured over the decking.

6. The multistory building construction system according to claim 5 wherein the exterior dimension of the at least one upper-floor column is substantially similar to an exterior dimension of the at least one first-floor column.

7. The multistory building construction system according to claim 5 wherein the exterior dimension of the at least one upper-floor column of a second floor of a multistory building is slightly smaller than an exterior dimension of the at least one first-floor column and the exterior dimension of the at least one upper-floor column of each floor above the second floor of the multistory building is slightly smaller than the exterior dimension of the at least one upper-floor column of a floor immediately below.

8. A multistory building construction system comprising:

At least one base plate comprising a centrally disposed sleeve affixed to and extending vertically from a top surface thereof, and a plurality of openings disposed therein to, permit passage of a corresponding plurality of fasteners;

at least one first-floor column comprising a cap plate disposed on and affixed to a top end thereof with a lateral dimension greater than a lateral dimension of the at least one first-floor column, so that the cap plate projects beyond the lateral dimension of the first-floor column on two opposing sides of the first-floor column, a sleeve centrally disposed on and affixed to a top surface of the cap plate and extending vertically therefrom, the sleeve having a lower surface that is centrally disposed on and affixed to a top surface of the cap plate, and at least one sheer tab disposed orthogonally to the lateral dimension of the first-floor column and oriented vertically; and at least one upper-floor column comprising a cap plate disposed on and affixed to a top end thereof with a lateral dimension greater than a lateral dimension of the at least one upper-floor column, so that the cap plate projects beyond the lateral dimension of the upper-floor column on two opposing sides of the upper-floor column, a sleeve centrally disposed on and affixed to a top surface of the cap plate and extending vertically therefrom, the sleeve having a lower surface that is centrally disposed on and affixed to a top surface of the cap plate, and at least one sheer tab disposed orthogonally to the lateral dimension of the upper-floor column and oriented vertically;

wherein the at least one first-floor column has a cross-sectional shape that is substantially similar to a cross-sectional shape of the sleeve of the base plate, the at least one first-floor column has an interior dimension slightly larger than an exterior dimension of the sleeve of the base plate, the cross-sectional shape of the sleeve of the cap plate of the at least one first-floor column is substantially similar to a cross-sectional shape of the at least one upper-floor column, the sleeve of the cap plate of the at least one first-floor column has an interior dimension slightly larger than an exterior dimension of the at least one upper-floor column, the sleeve of the cap plate of the at least one first-floor column has a vertical dimension substantially similar to a thickness of a concrete floor poured over a decking and the sleeve of the cap plate of the at least one upper-floor column has a vertical dimension substantially similar to the thickness of the concrete floor poured over the decking.

* * * * *